US007127847B2

(12) United States Patent
Fitzgibbon et al.

(10) Patent No.: US 7,127,847 B2
(45) Date of Patent: Oct. 31, 2006

(54) BARRIER MOVEMENT CONTROL SAFETY METHOD AND APPARATUS

(75) Inventors: James J. Fitzgibbon, Batavia, IL (US); Edward Laird, Lombard, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/078,138

(22) Filed: Feb. 19, 2002

(65) Prior Publication Data

US 2003/0154656 A1 Aug. 21, 2003

(51) Int. Cl.
*E05F 15/02* (2006.01)

(52) U.S. Cl. ..... 49/28; 49/26

(58) Field of Classification Search ..... 49/26, 49/27, 28, 29, 30, 197, 199; 200/61.43
See application file for complete search history.

(56) References Cited

U.S. PATENT DOCUMENTS 4,328,540 A 5/1982 Matsuoka et al.
4,408,146 A * 10/1983 Beckerman ..... 318/264
4,638,433 A 1/1987 Schindler
4,922,168 A 5/1990 Waggamon et al.
5,684,372 A 11/1997 Fitzgibbon et al.
5,912,625 A 6/1999 Scofield
5,962,825 A 10/1999 Miller
5,969,637 A * 10/1999 Doppelt et al. ..... 49/28
5,998,950 A * 12/1999 Fitzgibbon et al. ..... 49/28
6,025,785 A 2/2000 Farris et al.
6,107,765 A 8/2000 Fitzgibbon et al.
6,111,374 A 8/2000 Fitzgibbon et al.
6,239,569 B1 5/2001 Fitzgibbon et al.
6,326,751 B1 * 12/2001 Mullet et al. ..... 49/26
6,388,412 B1 5/2002 Reed et al.
6,563,278 B1 5/2003 Roman

OTHER PUBLICATIONS

Search Report for PCT patent application PCT/US03/04834 mailed Jan. 20, 2004.

* cited by examiner

*Primary Examiner*—Jerry Redman
(74) *Attorney, Agent, or Firm*—Fitch, Even, Tabin & Flannery

(57) ABSTRACT

A barrier mount system is disclosed which opens and closes a barrier such as a gate or garage door in response to user generated commands. Obstruction detection apparatus is provided for safety of operator. When an obstruction is sensed, the barrier movement system is inhibited from responding to user generated commands until a predetermined event occurs. The event may be passage of a predetermined amount of time or barrier movement of a particular amount.

15 Claims, 4 Drawing Sheets

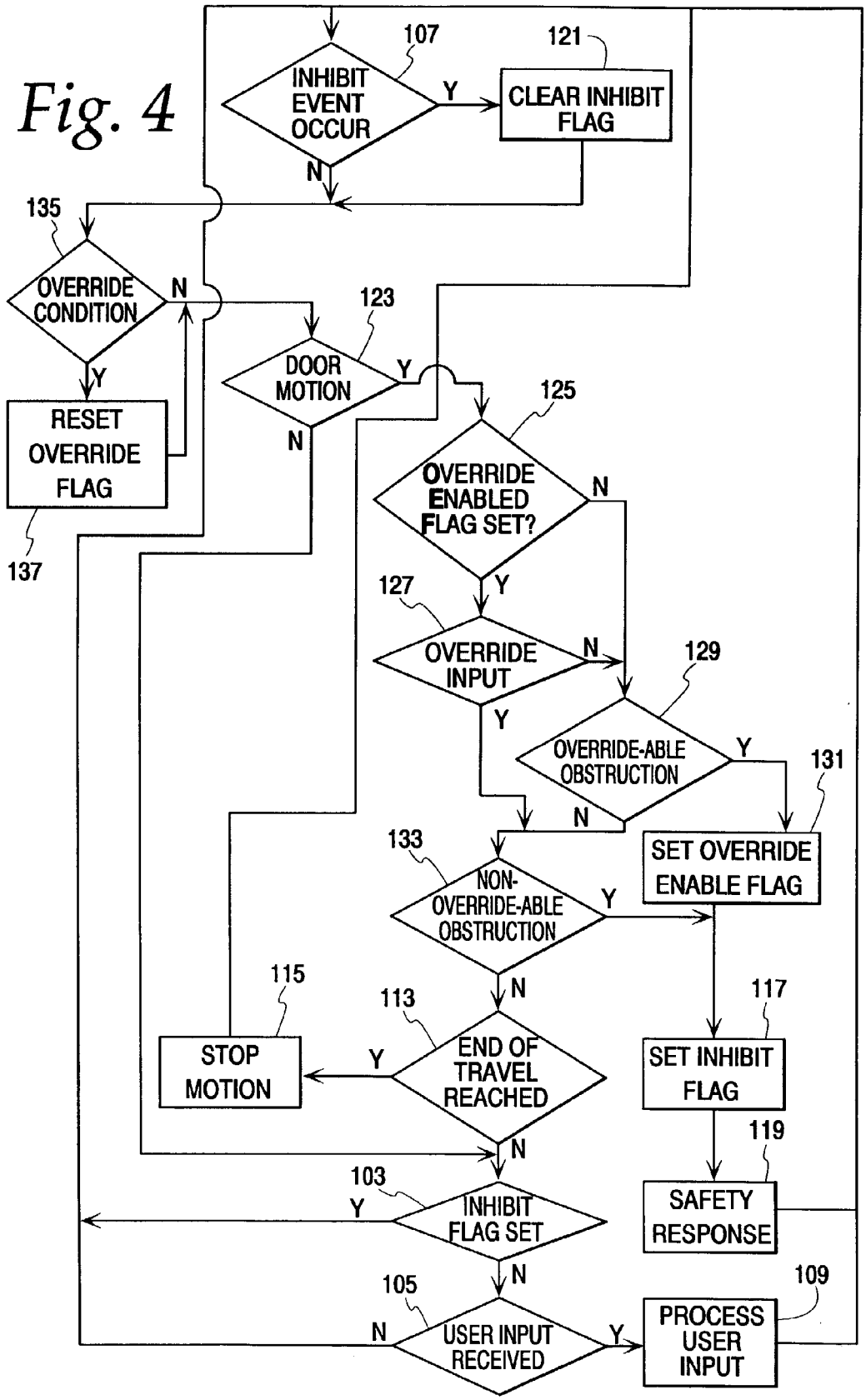
Fig. 4
INHIBIT EVENT OCCUR
107
Y
N
CLEAR INHIBIT FLAG
121
OVERRIDE CONDITION
135
N
Y
RESET OVERRIDE FLAG
137
DOOR MOTION
123
Y
N
OVERRIDE ENABLED FLAG SET?
125
N
Y
OVERRIDE INPUT
127
N
Y
OVERRIDE-ABLE OBSTRUCTION
129
Y
N
SET OVERRIDE ENABLE FLAG
131
NON-OVERRIDE-ABLE OBSTRUCTION
133
Y
N
END OF TRAVEL REACHED
113
Y
STOP MOTION
115
SET INHIBIT FLAG
117
SAFETY RESPONSE
119
N
INHIBIT FLAG SET
103
Y
N
USER INPUT RECEIVED
105
N
Y
PROCESS USER INPUT
109

BARRIER MOVEMENT CONTROL SAFETY METHOD AND APPARATUS

The present invention relates to safety systems for use with automated movable barriers.

Many types of automatic movable barrier systems are in use today. Examples of such are garage door, gate and awning controllers. With such systems a motor is coupled to the barrier and is controlled by a controller to open and close the barrier in response to directions which are usually provided by a human operator. Some barrier movement systems incorporate sensing operations and control circuitry to provide safety of operation. For example, a garage door opener may include a force sensor to identify when the door is being pushed or pulled too hard by the motor at a given point in its travel. When too much force is sensed, an obstruction to door travel is assumed and the motor may be stopped and/or reversed to stop possibly harmful force. The use of optical or ultrasonic sensors to scan the opening being closed and opened by the barriers and to stop and/or sense door movement when a physical obstruction is detected in the opening is also known. Such safety systems rely on sensing, signaling and decision making apparatus such as a microprocessor controller to complete their safety function. A barrier movement control systems primarily respond to user initiated signals to control barrier movement. Such user signals may be transmitted from wall mounted switches or wireless code transmitters. Generally, the system is constructed so that the user initiated signals override at least some of the control signals generated by an electronic controller for system safety. Thus, in some instances human operators have been given precedence over an electronic safety system. Although existing systems have proven to be reliable and to provide a safe operating environment designs may have, in some cases, permitted panicked human interaction to override the automatic safety features.

SUMMARY OF THE INVENTION

As described below a barrier movement system comprises a controller for controlling a motor to move a barrier between open and closed positions. The controller response to user initiated commands to control the position and movement of the barrier. When an obstruction is sensed by associated apparatus the barrier movement is stopped and the controller ceases to respond to user initiated commands.

The cessation of response to user initiated commands may last only until a predetermined event occurs. The predetermined event may be a number of things, including the passage of a predetermined time, the movement of the barrier by a predetermined amount or the change of state of the barrier movement system. Such change of state may, for example, be when the door reaches an upper or lower travel limit or when a subsequent obstruction is sensed.

BRIEF DESCRIPTION OF THE DRAWINGS

FIG. 4 is a flow diagram of operations occasioned when an obstruction is sensed while a barrier is being moved.

DETAILED DESCRIPTION

Figure 1:
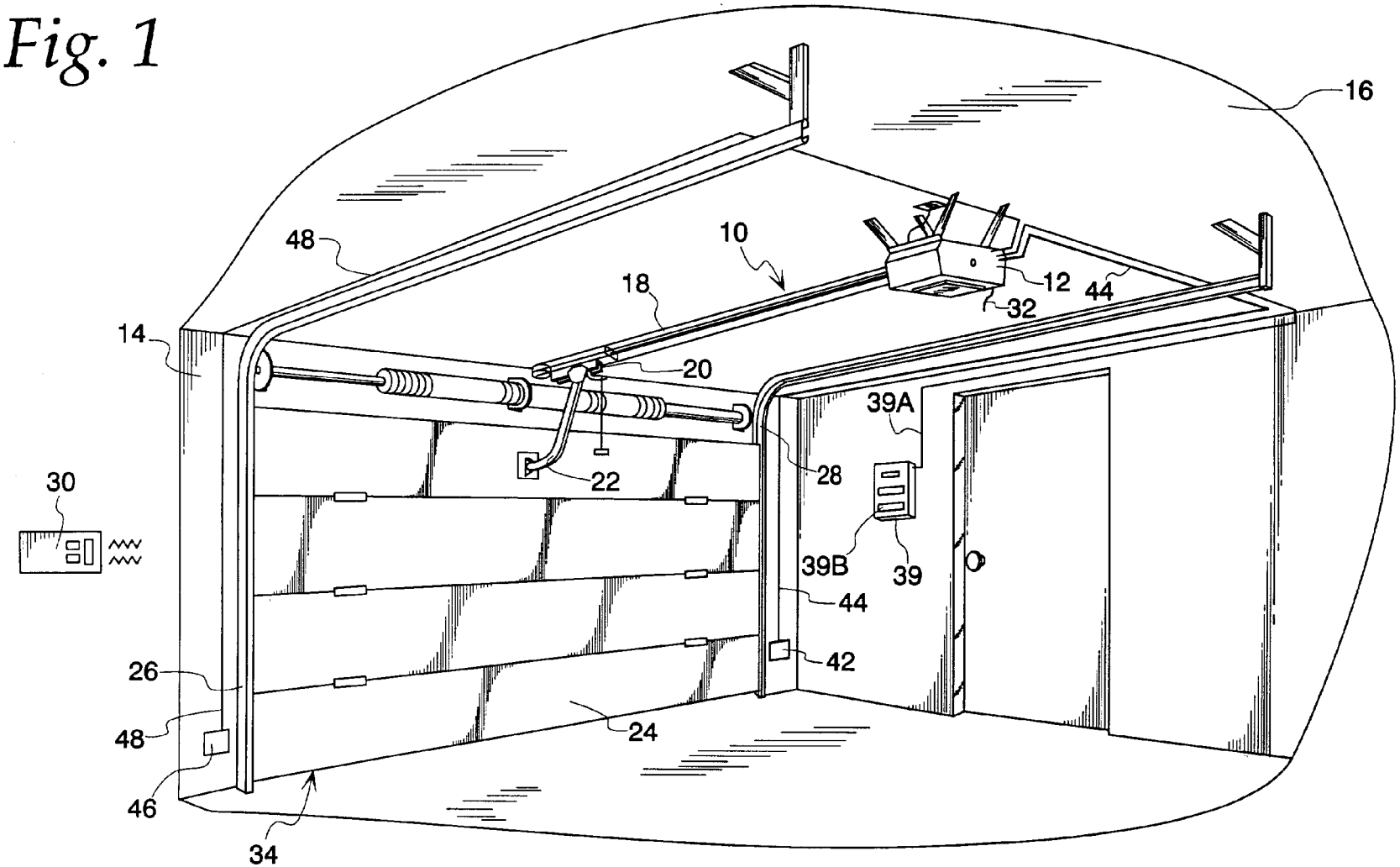
FIG. 1 is a representation of an arrangement for opening and closing a garage door.

Referring now to the drawings and especially to FIG. 1 a movable barrier operator or garage door opener is generally shown therein and referred to by numeral 10. The operator includes a head unit 12 mounted within a garage 14. More specifically, the head unit 12 mounted to the ceiling of the garage 14 and includes a rail 18 extending therefrom with a releasable trolley 20 attached having an arm 22 extending to a multiple paneled garage door 24 positioned for movement along a pair of door rails 26 and 28. The system includes a hand-held transmitter unit 30 adapted to send rf coded command signals to an antenna 32 positioned on the head unit 12 and coupled to a rf receiver of the head end. A switch module 39 is mounted on a wall of the garage. The wall control module 39 is wire connected to the head unit by a pair of wires 39*a*. In other embodiments the wall control may communicate with the head end via rf. The wall control module 39 includes a command switch 39*b*, which may be pressed by a user to operate door control commands. An optical emitter 42 is connected via a power and signal line 44 to the head unit. An optical detector 46 is connected via a wire 48 to the head unit 12. The optical emitter 42 and detector watch, the door opening to identify possible obstructions to door travel.

Figure 2:
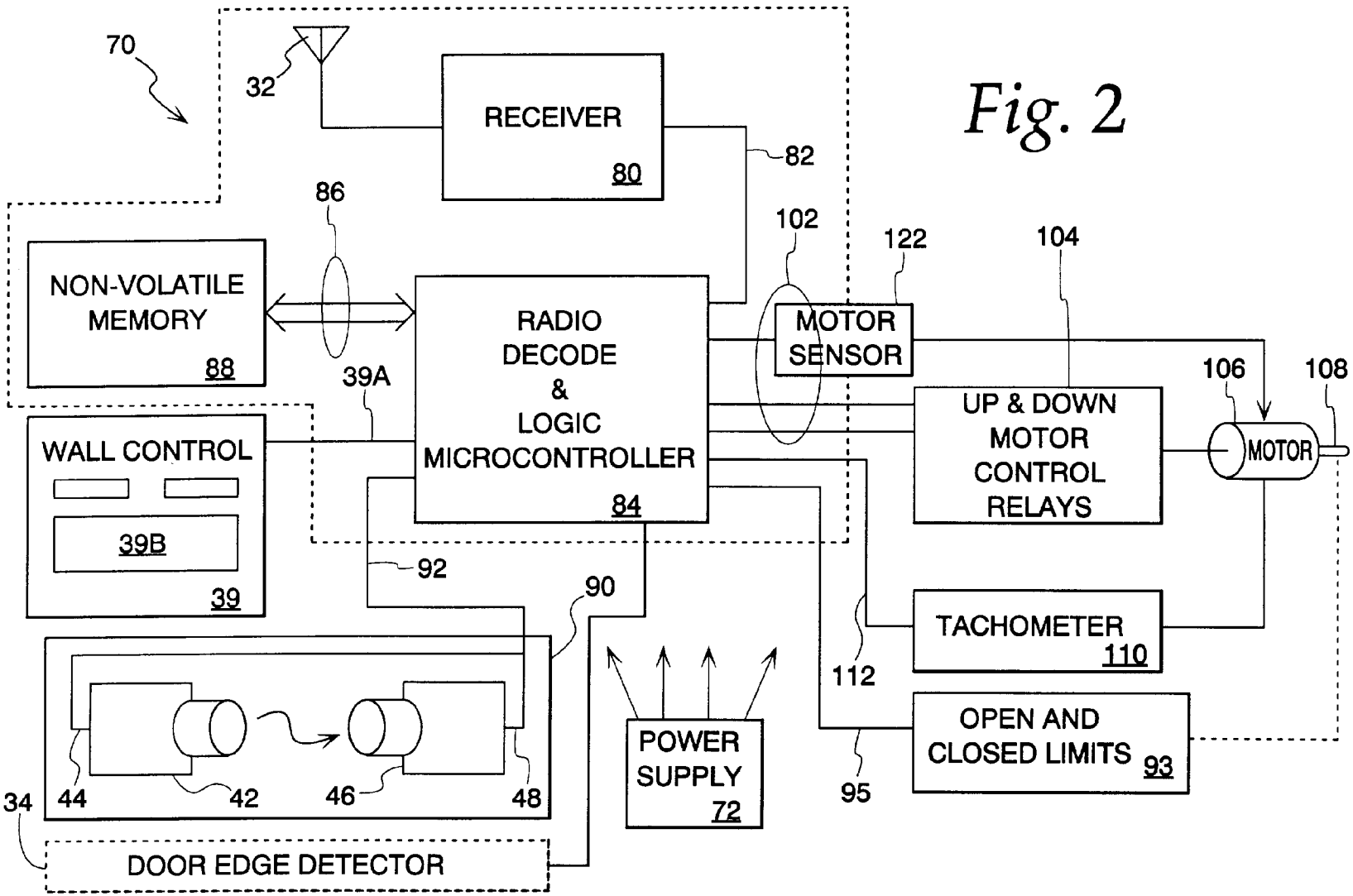
FIG. 2 is a block diagram representing the control structure of a barrier movement system.

As shown in FIG. 2, the garage door operator 10, which includes the head unit 12 has a controller 70 which having the antenna 32. The controller 70 includes a power supply 72 which receives alternating current from an alternating current source, such as 110 volt AC, and converts the alternating current to required levels of DC voltage. The controller 70 includes rf receiver 80 coupled via a line 82 to supply demodulated digital signals to a micro-controller 84. The receiver 80 is energized by the power supply 72. The micro-controller is also coupled by a bus 86 to a non-volatile memory 88, which non-volatile memory stores user codes, and other digital data related to the operation of the control unit. An optical detector 90, which comprises the emitter 42 and infrared detector 46 is coupled via an obstacle detector bus 92 to the micro-controller 84. The obstacle detector bus 92 includes lines 44 and 48. In other embodiments the optical detector 90 may utilize other sensing capabilities such as high frequency sound. The embodiment may also include an optional door edge detector 34 to detect physical contact of the door with an obstruction in the door's path (the opening). The wall switch 39 is connected via the connecting wires 39*a* to the micro-controller 84. The micro-controller 84, in response to switch closures and received rf codes, will send signals over a relay logic line 102 to a relay logic module 104 connected to an electric motor 106 having a power takeoff shaft 108 coupled to the trolley 20 to raise (open) and lower (close) the door 24. A tachometer 110 is coupled to the shaft 108 and provides motor rotation signals on a tachometer line 112 to the micro-controller 84; the tachometer signal being indicative of the speed of rotation of the motor. The apparatus also includes up limit switches and down limit switches which respectively sense when the door 24 is fully open or fully closed. The limit switches are shown in FIG. 2 as a functional box 93 connected to micro-controller 84 by leads 95. Door open and closed limits may also be detected internally by micro-controller 84 by counters which reflect door movement from the motor rotation signals on conductor 112. Additionally, the arrangement of FIG. 2 may include a motor power or current sensor 122 connected to micro-controller 84. Motor sensor senses the power and/or current used by motor 106 and generates an obstruction signal when a threshold is exceeded.

Figure 3:
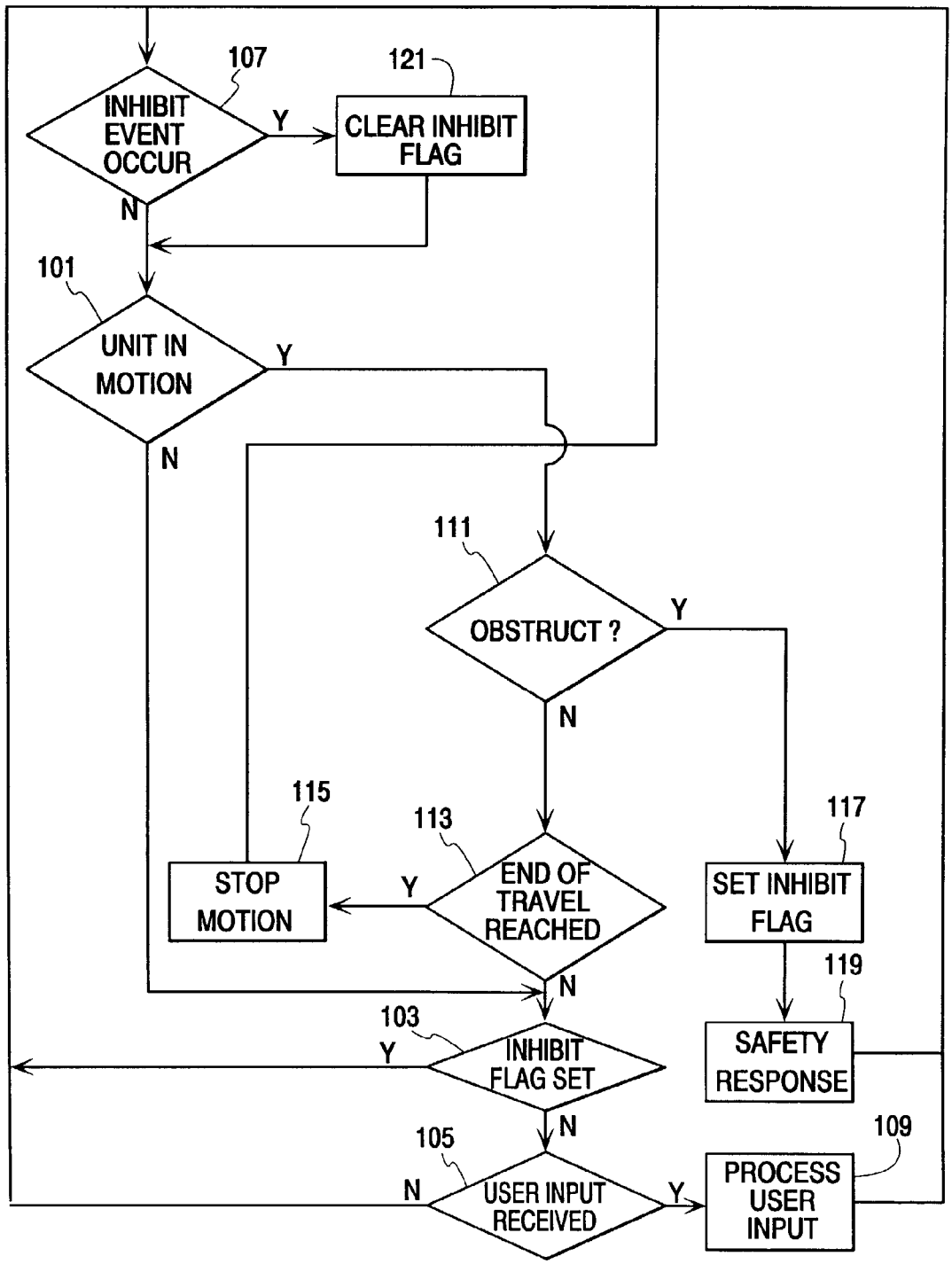
FIG. 3 is a flow diagram showing the control of the system of FIG. 2.

FIG. 3 is a flow diagram of an embodiment of operation of the system of FIGS. 1 and 2. The flow diagram shown in FIG. 3 is a continuous loop which is initially entered when at system start up. The description of FIG. 3 begins at block 101 where a check of tachometer 110 is made to determine whether door 24 is moving. In other embodiments a check of a present state of the system can be used to evaluate that the door is in motion. When the door is not in motion, flow proceeds to a block 103 where a check is made to see whether a flag has been set to indicate whether user commands are being inhibited. The setting and clearing of the inhibit flag are discussed later herein. When the user command inhibit flag is not set a check is made in block 105 to determine whether a user input has occurred. When no user input has been received, flow proceeds to block 107 to determine whether an event has occurred to result in clearing the inhibit flag. The event mentioned may be for example, the passage of a predetermined amount of time since the inhibit flag was set or the movement of the barrier by a predetermined amount since the setting of the inhibit flag. The flow will remain in the above described sub-loop consisting of blocks 101, 103, 105 and 107 until a user command input is received and detected in block 105.

When a user input is detected in block 105 flow proceeds to block 109 where the user input command is responded to by beginning pre-established movement of the door. Such movement (or stoppage) is in accordance with known principles and may result in the door being moved up, moved down or stopped. For the present description it is assumed that the door has been commanded to move. After the user input is acted on in step 109 flow proceeds to step 107 to detect whether the obstruction inhibit flag is to be cleared, then onto step 101 which detects that the door is in motion and flow proceeds to block 111 to detect whether an obstruction is being sensed by the door edge detector 34, the optical detector 90, the tachometer 110 or the motor sensor 122. When no obstruction is sensed flow proceeds to block 113 to determine whether an end of travel has been detected. Such an end of travel will be signaled by the open and closed limits 93 or the tachometer 110 in conjunction with a position monitoring register of the micro-controller 84.

When an end of travel is detected in block 113 flow proceeds to block 115 to stop motion of the barrier. After block 115 stops the door flow proceeds to block 107 which functions as above described.

When block 113 does not detect the end of travel flow will continue to loop until end of travel is reached or and obstruction is detected in block 111. When such an obstruction is sensed, flow proceeds via block 117 where the user input inhibit flag is set to block 119 where a safety response is initiated. Such a safety response is generally known and depends upon the direction of door travel and in alternate situations which sensor detected the obstruction. When the user inhibit flag is set, flow proceeds as before, however step 103 will cause the flow to ignore user command input by diverting flow from block 103 to block to block 107 without entering the user input received block 105. Thus, further obstructions will be sensed and automatically responded to; to the exclusion of user input commands.

The user command inputs are excluded until the occurrence of a predetermined event. That event, which may be the passage of a predetermined amount of time or the movement of the barrier for a predetermined distance, will be detected in decision block 107 which is traversed during each loop or sub-loop through the flow diagram. When block 107 detects the occurrence of the event, a block 121 is performed where the inhibit flag is cleared. With the clearance of the inhibit flag block 103 will again cause flow to proceed through block 105 to identify whether user commands are received and to act on them as needed.

FIG. 4 is a flow diagram of another embodiment which permits a user to override certain types of detected obstructions. In the present description an overridable obstruction is considered to be an infra-red detector 90 detected obstruction while a non-overridable obstruction is a motor sensor 122, a door edge 34, a tachometer 110 detected obstruction. Other combinations of obstruction detection may be combined into overridable and non-overridable obstructions in other embodiments.

The general flow of FIG. 4 is substantially the same as FIG. 3 except that blocks 125–133 control the detection and implementation of the override functions. Also blocks 135 and 137 are used to test and reset an override enable flag. When door movement block 123 detects door movement, a block 125 is entered to detect whether the override flag has been set. The override flag being set represents a special condition discussed below. When the override flag is not set, flow proceeds to block 129 which detects whether an overridable obstruction has been sensed. The overridable obstruction, in the present example, is an obstruction signaled by the IR detector 90. When no such overridable obstruction is detected flow proceeds to block 133 where a test is performed to see whether a non-overridable obstruction has been detected. When no non-overridable obstruction is sensed flow proceeds to block 113 as with the embodiment of FIG. 3.

When block 129 detects an overridable obstruction, flow proceeds to block 131 where an override flag is set and then onto block 117 in which the enable flag is set as discussed in regard to FIG. 3. When block 125 is next performed the override flag will be sensed and flow will proceed to block 127 where a check is performed to determine whether a user is generating a special override input. Such a special override input might comprise the continuous pressing of a wall controller button 39 or pressing a special button dedicated to this purpose. When block 127 does not detect an override input from the user flow proceeds to block 129. Alternatively, when block 127 detects a user override input flow proceeds to block 133, to detect a non-overridable obstruction as before. In addition to new blocks 125–133 FIG. 4 includes block 135 and 137 which cooperate to clear the override flag on the occurrence of an override condition. In the present embodiment the inhibit flag will be cleared by block 121 approximately 2½ seconds after it is set. The override flag will not be reset by the block 137 until approximately 90 seconds pass. Accordingly, the override input by the user will not be made active by the user input process 109 for approximately 2½ seconds after the detection of an overridable obstruction. Thereafter the inhibit flag will be cleared and the user permitted control of the system to the exclusion of the overridable obstruction detector for the remaining 0.87½ seconds before which the override flag will be reset. In this way the user, by using a special override input command, can have direct control of the system to the exclusion of overridable obstructions.

While there has been illustrated and described particular embodiments, it will be appreciated that numerous changes and modifications will occur to those skilled in the art, and it is intended in the appended claims to cover all those changes and modifications which fall within the true spirit and scope of the present invention.

What is claimed is:

1. A barrier movement system for opening and closing a barrier comprising:

a motor connected to the barrier;

a controller responsive to user initiated signals controlling the motor to move the barrier to open and closed positions;

user controlled apparatus transmitting user initiated signals to the controller to control barrier movement;

obstruction sensing apparatus generating an obstruction signal representing the detection of an obstruction to barrier movement in a first direction;

the controller responds to the obstruction sensing apparatus by determining whether a sensed obstruction is overridable by user input; and the controller while moving the barrier responds to the obstruction signal when the sensed obstruction is not overridable by stopping movement of the barrier in the first direction, automatically performing a safety response and inhibiting response to the user initiated signals.

2. A barrier movement system in accordance with claim 1 wherein the apparatus for generating an obstruction signal comprises force detecting apparatus for detecting a force applied by the motor to the barrier.

3. A barrier movement system in accordance with claim 1 wherein the apparatus for generating an obstruction signal comprises an optical obstruction detection device.

4. A barrier movement system in accordance with claim 1 wherein the apparatus for generating an obstruction signal comprises a force detecting arrangement on a leading edge of the barrier moving in the first direction.

5. A barrier movement system in accordance with claim 1 wherein the inhibiting of response to user initiated signals continues until the occurrence of a predetermined event.

6. A barrier movement system in accordance with claim 5 wherein the predetermined event comprises the passage of a predetermined period of time.

7. A barrier movement system in accordance with claim 1 wherein the safety response of the controller to the obstruction signal comprises reversing direction of movement of the barrier and the predetermined event comprises movement of the barrier a predetermined distance in the reverse direction.

8. A barrier movement system in accordance with claim 7 wherein the barrier moves between an open limit and a closed limit and the controller inhibits the response to user initiated signals until the barrier has reached an open limit.

9. A barrier movement system in accordance with claim 7 wherein the barrier moves between an open limit and a closed limit and the controller inhibits the response to user initiated signals until the barrier has reached a predetermined limit.

10. A barrier movement system in accordance with claim 1 wherein the obstruction sensing apparatus comprises apparatus for detecting the presence of an object in an opening to be closed by the barrier and for generating a sensed object signal; and the controller responds to the sensed object signal by controlling the barrier to move toward the open limit and inhibiting the response to user initiated signals until the barrier has reached the open limit.

11. A barrier movement system in accordance with claim 1 wherein the obstruction sensing apparatus comprises apparatus for detecting the force applied by the motor to the barrier and for generating an over force signal; and the controller responds to the over force signal by inhibiting the response to user initiated signals for a predetermined period of time.

12. A barrier movement system in accordance with claim 1 wherein the apparatus for generating an obstruction signal comprises a sonic or ultrasonic obstruction detection device.

13. A barrier movement system in accordance with claim 1 wherein after a response to the obstruction signal, the user initiated signals are enabled to override response by the controller to obstruction signals when the sensed obstruction is determined to be overridable.

14. A barrier movement system in accordance with claim 13 wherein the override of controller response to obstruction signals is disabled after a period of time.

15. The barrier movement system in accordance with claim 13 wherein the override of controller response to obstruction signals is disabled when a predetermined state of the operator is reached.

* * * * *